United States Patent [19]

Curr et al.

[11] 4,441,921

[45] Apr. 10, 1984

[54] PRODUCTION AND TREATMENT OF FERROCHROMIUM

[75] Inventors: Thomas R. Curr, Johannesburg; Nicholas A. Barcza, Randburg, both of South Africa

[73] Assignees: Council for Mineral Technology, Randburg; Middelburg Steel and Alloys (Proprietary) Limited, Sandown, both of South Africa

[21] Appl. No.: 434,753

[22] Filed: Oct. 18, 1982

[30] Foreign Application Priority Data

Oct. 19, 1982 [ZA] South Africa ..... 81/7210

[51] Int. Cl.[3] ..... C21B 4/00

[52] U.S. Cl. ..... 75/10 R; 75/12; 75/130.5

[58] Field of Search ..... 75/10–12, 75/130.5

[56] References Cited

U.S. PATENT DOCUMENTS

| | | | |
|---|---|---|---|
| 3,301,669 | 1/1967 | Rathmann | 75/130.5 |
| 3,347,766 | 10/1967 | Death et al. . | |
| 3,523,021 | 8/1970 | Khitrik | 75/130.5 |
| 3,615,349 | 10/1971 | Bleloch | 75/12 |
| 3,992,193 | 11/1976 | Fey et al. . | |
| 3,997,333 | 12/1976 | Fey . | |
| 4,006,284 | 2/1977 | Segsworth et al. . | |
| 4,061,492 | 12/1977 | Fey et al. . | |
| 4,148,628 | 4/1979 | Fukunishi et al. . | |

OTHER PUBLICATIONS

*Chemical Engineering*, "Plasma Process is Ready for Metals Recovery", (Feb. 26, 1979), pp. 75–77, (by: Peter R. Savage).

*Journal of Metals*, "In-Flight Plasma Reduction of Domestic Chromite", (Aug. 1981), pp. 43–49, (By: J. J. Moore, K. J. Reid, J. K. Tylko).

*Primary Examiner*—Peter D. Rosenberg

*Attorney, Agent, or Firm*—Finnegan, Henderson, Farabow, Garrett & Dunner

[57] ABSTRACT

A process for the production of ferrochromium by smelting chromite ore and in which ferrochromium fines may form a part of the feed materials, or for the further treatment of ferrochromium fines alone, in each case in the presence of a limited amount of carbonaceous reductant, is provided. The amount of reductant is generally limited to a maximum of 150% of the stoichiometric amount required for reduction of all the chromium and iron to metal or carbide form and to produce the required level of silicon in the product (normally 2 to 4%). The process is carried out by feeding the preferably premixed feed materials to a liquid slag phase in the bath of the furnace at a rate chosen to maintain the molten state and temperature of such material. Oxygen is substantially excluded from the reaction zone which is heated by a transferred arc thermal plasma. The feed materials generally include slagging agents chosen to ensure that the slag liquidus temperature and metal liquidus temperature are roughly the same or that of the slag is less than that of the metal, but in any event such that the slag phase remains liquid throughout the process.

15 Claims, No Drawings

PRODUCTION AND TREATMENT OF FERROCHROMIUM

BACKGROUND TO THE INVENTION

This invention relates to the production and treatment of ferrochromium and, in particular, but not exclusively, to the smelting of chromite ore to produce ferrochromium, as well as to the further treatment of ferrochromium fines to a condition in which they are in a more acceptable and pure form.

Insofar as this invention relates to the melting of ferrochromium fines, the only process of concern is the melting of ferrochromium fines, together with solid carbonaceous reductant, in order to achieve improved yields, as well as the melting of fines. Thus the area of melting of ferrochromium fines together with solid carbonaceous reductant, as far as this invention is concerned, could be considered tantamount to smelting in view of the reduction which takes place of unreduced chromite ore often contained in slag portions of ferrochromium fines.

Thus, in broad principle, the invention relates primarily to the smelting of chromite ores in the presence of carbonaceous reductant material in order to produce ferrochromium. Such chromite ores may have undergone some form of pre-treatment such as concentration, pre-heating, pre-oxidation, pre-reduction or pre-leaching. Also, they may be agglomerated, pelletized or briquetted.

Smelting of many different types of chromite ore, whether as a lumpy ore, as briquettes, or as ore fines, in a conventional submerged arc type of furnace, invariably results in appreciable losses of potentially reduceable oxides of iron and chromium to the slag. These losses are largely in the form of unreduced or partly reduced chromium spinel. As a result of this, recoveries of as low as 65% to 70% are often regarded as acceptable.

Smelting in a submerged arc furnace takes place beneath a burden of feed material which automatically feeds into the reaction zone under the influence of gravity. This type of feeding denies any sort of reasonable control over the rate at which feed material is fed into the reaction zone beneath the electrodes. As a result, irrespective of sophisticated computerised control which can be applied to such furnaces, satisfactory recoveries on an absolute scale are not generally achieved.

Even in order to achieve the modest recoveries which are at present regarded as acceptable, selection of suitable carbonaceous reducing agents is necessary and, such reducing agents are very often more costly than other carbonaceous reducing agents, such as coal, which should, technically speaking, be adequate for the purpose.

Applicant believes that in the case of presently used techniques and equipment the liquidus temperature of the slag is very often not fully reached as a result of which the chromite fails to dissolve, and thus be reduced rapidly, as opposed to the relatively extremely slow solid state reduction of chromite. This phenomenon may be attributed to the lack of control over the feed material in a submerged arc furnace.

It is accordingly the object of this invention to provide a process for the production and treatment of ferrochromium wherein the overall recoveries of chromium are substantially improved and, whilst not necessarily being the case, less costly carbonaceous reductants can be employed.

In this specification the term "stoichiometric" is intended to mean the quantity of reductant required to reduce all the oxides of chromium and iron to the metallic or carbide form and to produce the required level of silicon in the product (normally 2 to 4%). Thus the stoichiometric quantity of carbonaceous reductant is calculated on the fixed carbon content of the reductant.

Also, the term transferred arc thermal plasma is defined at least for present purposes, as an electrically generated plasma in which the ion temperature lies in the range 5000 K. to 60,000 K. and the molten material in the bath forms a substantial part of the electrical circuit.

BRIEF SUMMARY OF THE INVENTION

In accordance with this invention there is provided a process for the production or treatment of ferrochromium by the formation of molten ferrochromium in a furnace bath in the presence of a carbonaceous reductant and wherein feed materials including at least some unreduced or partly reduced oxides of chromium and iron, carbonaceous reductant material, and slaggings agents are each fed, at a controlled rate, to a reaction zone in the bath which consists of at least liquid slag and molten metal wherein the reaction zone is heated by means of a transferred arc thermal plasma, said feed materials including slagging agents chosen to provide a slag liquidus temperature not appreciably higher than the metal liquidus temperature in the furnace, air being substantially excluded from the reaction zone.

Further features of the invention provide for the amount of carbonaceous reductant material to be less than 150% preferably 120% and most preferably about 105% of the stoichiometric amount thereof; for the maintenance of the partial pressure of oxygen in the reaction zone at a maximum of $10^{-8}$ atmospheres and, preferably, of the order of $10^{-12}$ atmospheres for at least the major part of the duration of the process; for the feed materials fed to the furnace to be purged with inert gas, such as argon, prior to being fed to the reaction zone; for the interior of the furnace to be at a slight positive pressure in order to enhance the exclusion of air; for the transferred arc thermal plasma to be generated by a d.c. power supply; and for the transferred arc thermal plasma to be a precessive plasma arc with the electrode or plasma generator mounted in any geometrical arrangement or member above the molten bath.

Still further features of the invention provide for the feed materials to be intimately premixed, although they may be separately fed to the furnace; for the feed materials to include chromite as the source of the oxides of chromium and iron which may form the sole of predominant source of such oxides and for the feed materials to be optionally pretreated as hereinbefore mentioned.

Regarding the partial pressure of oxygen it is considered that a pressure of $10^{-12}$ atmospheres would be desirable to attain the most favourable dissolution of the chromite spinel in the feed materials and to attain the most favourable equilibrium in the process.

It has been found that the partial pressure of oxygen has a direct bearing on the solubility in the slag of the chromite oxide from the chromite spinel in the feed. It is this dissolution which leads to the rapid reduction showed by the use of the invention. Thus whilst the solubility of chromite in the slag at atmospheric conditions is substantially zero it is about 40% when the oxygen partial pressure is $10^{-8}$ atmospheres.

It is preferred to add slagging agents to the feed materials in quantities calculated to provide a liquidus temperature of the slag of about the same or, alternatively, slightly less than the liquidus temperature of the ferrochromium metal being produced in the furnace. The liquidus temperature may be higher provided it is ensured that fully liquid conditions of the slag are maintained. Also, it has been found, the lime can be used to advantage as a flux in order to ensure that ferrochromium with an acceptable silicon content is produced whilst optimum chromite reduction is achieved. Sulphur is also refined out using lime. Other refining agents could also be added, for example, for refining the titanium or phosphorus contents. Such refining agents could be added after the main reaction.

Another advantage of the invention is that in the refining of carbon and silicon, where this takes place, titanium is automatically refined to advantageous levels.

DETAILED DESCRIPTION OF THE INVENTION

In general the process of the invention is applied to the smelting of chromite ore which may, if required, be mixed with any proportion of ferrochromium metal fines in order to recycle such fines. It is to be noted that, as a result of the heating in the transferred arc thermal, plasma the high electrical conductivity of ferrochromium fines does not adversely affect the process as would be the case in a submerged arc furnace. In fact, the feed material could be basically ferrochromium metal fines together with the usual slag which accompanies them and which contains unreduced or partly reduced chromite ore together with solid carbonaceous reductant. In either of these instances ferrochromium metal is produced and a reduction of at least some chromite or partly reduced chromite is achieved in the process.

Solid carbonaceous reductant is included in the feed materials which may be premixed and, whilst such carbonaceous reductant can in fact be coke or char, it has been found that relatively low grade coal can be used to great advantage in exercising the present invention. The employment of such coal is advantageous, not only from the point of view of it being less costly than the other carbonaceous reductants mentioned, but in addition, the furnace can be operated at higher power thereby giving higher production. As an example, in one particular furnace, where 100% char was used as the reductant, a power of only 400 kW was possible whilst, when 100% low grade coal was employed an operating power of 600 kW was achieved.

Clearly the feed materials must be added in the chosen proportions, with or without premixing feed and at a rate controlled to be substantially equal to the rate at which dissolution of chromite in the liquid slag and reduction takes place in the reaction zone. The control of the addition of feed materials in the case of a transferred arc plasma furnace is one major advantage over the submerged arc furnaces where the burden feeds itself as it is consumed and, indeed, the reactions taking place in the reaction zone probably never go to completion. Reverting to the carbonaceous reluctant it is to be mentioned that an excess of carbon will be employed as a general rule as some carbon will doubtless be consumed in reacting with small amounts of oxygen which naturally leak into the interior of the furnace. This excess is based on the amount of carbon required to produce an off-gas consisting predominantly of carbon monoxide and not for any other known reason.

The other slagging agents employed can be of the usual type namely, quartzite, dolomite, limestone and serpentine, for example.

In order that the invention will be more fully understood various tests conducted to date will be discussed below and the results given.

EXAMPLE 1

Non-Consumable Cathode

The furnace employed for the purpose of carrying out the tests was a 1400 kV.A furnace manufactured by Tetronics Research and Development Company Limited substantially in accordance with their issued British Pat. Nos. 1390351/2/3 and 1529526. Further description of the furnace may be obtained by reference to the abovementioned patents and information literature of Tetronics Research and Development Company Limited. Suffice it to say that the furnace was of the expanded precessive plasma arc type having an upper and centrally located plasma gun of the non-consumable electrode type, which precessed at variable rates, but for the purposes of these tests, at a rate of 50 rpm. The plasma gun was of the direct current type and the anodic contact in the bath assumes the form of an annulus.

In one series of tests which was carried out without controlling oxygen ingress to the system a helical screw type of feed device was employed but in the later experiments in which oxygen was substantially excluded from the furnace, as required by the invention, plough and table type feeding was achieved in flexible tubes purged with argon gas. In the latter set of experiments the furnace was run at a slight positive pressure to further exclude oxygen and a pressure of about 25 Pa. (gauge) was employed. Such positive pressure was achieved by restricting the flow of off-gasses to a suitable extent.

The raw materials used for the test work were Winterveld chromite, Springbok No. 5 seam coal, and Rand Carbide char in the minus 2 mm size range as well as a larger sized Springbok No. 5 seam coal (minus 12 mm plus 6 mm). Quartz, calcined lime of a high purity and limestone, were used as fluxes and care was taken to ensure that only dry materials were used in the trials to maintain consistent feed conditions throughout.

The melting test work on the high carbon ferrochromium metal fines was carried out on fines obtained from a South African furnace operator and in which the slag to metal ratio was 0,129, as defined in Tables 1 and 2.

The actual compositions of the raw materials are given in Table 1.

TABLE 1

Chemical analyses of the feed materials

| | % by mass | | | | | |
|---|---|---|---|---|---|---|
| FEED MATERIAL | $Cr_2O_3$ | FeO | $SiO_2$ | CaO | MgO | $Al_2O_3$ |
| CHROMIUM ORE: | | | | | | |
| Winterveld chromite | 44,6 | 23,3 | 2,23 | 0,20 | 11,2 | 13,7 |
| HIGH CARBON FERROCHROMIUM: | | | | | | |
| "Metal fines" | | | | | | |
| Metal* | — | — | — | — | — | — |
| Slag | 27,0 | 13,0 | 47,7 | 2,2 | 1,0 | 7,40 |

TABLE 1-continued

| Chemical analyses of the feed materials | | | | | | |
|---|---|---|---|---|---|---|
| FLUXES: | | | | | | |
| Quartz | — | 0,20 | 99,5 | — | — | 0,06 |
| Lime | — | 0,04 | 0,05 | 95,0 | 0,20 | — |
| Limestone | — | 0,46 | 2,07 | 55,0 | 0,53 | 0,54 |

*Metal portion of "Metal Fines" Cr 52,8, Fe 36,2, Si 3,0, C 6,55

| CARBONACEOUS REDUCING AGENTS: | Fixed Carbon | Volatiles | $SiO_2$ | $Al_2O_3$ | S | P |
|---|---|---|---|---|---|---|
| Finely sized coal | 54,3 | 33,4 | 7,5 | 2,5 | 0,63 | 0,004 |
| Larger sized coal | 51,4 | 36,7 | 8,50 | 5,40 | 0,64 | 0,005 |
| Finely sized char | 79,0 | 4,11 | 11,10 | 3,0 | 0,39 | 0,021 |

Notes:
1. Sulphur and phosphorus in "metal fines" were 0,026% and 0,014% respectively.
2. Slag to metal ratio in metal fines was 0,129.

The size distribution of the various raw materials are given in Table 2.

TABLE 2

| Particle size distribution of the feed materials | | | |
|---|---|---|---|
| Screen size mm | Mass % smaller than screen size | Screen size mm | Mass % smaller than screen size |
| Winterveld chromite | | Finely sized coal | |
| 1,70 | 99,55 | 2,00 | 99,8 |
| 1,18 | 95,29 | 1,68 | 96,3 |
| 0,850 | 83,83 | 1,00 | 64,7 |
| 0,600 | 64,66 | 0,85 | 55,9 |
| 0,425 | 46,03 | 0,71 | 48,1 |
| 0,300 | 30,25 | 0,60 | 40,1 |
| 0,212 | 19,71 | 0,50 | 34,2 |
| 0,150 | 13,00 | 0,42 | 27,2 |
| 0,106 | 8,28 | | |
| Finely sized char | | Quartz | |
| 0,71 | 86,60 | 0,710 | 99,93 |
| 0,600 | 1,00 | 0,500 | 97,93 |
| 0,430 | 0,80 | 0,250 | 56,63 |

Lime: 97% passed a 0,075 mm screen
Limestone: screened to pass a 6 mm screen and be retained by a 0,5 mm screen.

| | Screen size mm | Mass % Smaller than screen size |
|---|---|---|
| Larger sized coal: | 6,68 | 51,7 |
| | 4,70 | 15,0 |
| | 3,33 | 4,9 |
| | 1,65 | 1,0 |
| | 0,83 | 0,3 |
| Metal fines | 6,68 | 99,8 |
| | 2,36 | 86,7 |
| | 0,83 | 60,7 |
| | 0,42 | 43,7 |
| | 0,21 | 27,0 |
| | 0,10 | 12,4 |
| | 0,07 | 8,4 |

The feed compositions employed in the particular tests reported here are given in Table 3.

TABLE 3

| Feed Compositions Composition (Mass % of the ore/metal fines) | | | | | | | |
|---|---|---|---|---|---|---|---|
| Recipe Designation | Metal fines | Winterveld ore | Quartz | Lime | Coal −2 mm | Coal −12 mm | Coal −2 mm |
| M2 | 100,0 | — | — | — | 5,0 | — | — |
| S1/3 | — | 100,0 | 18,0 | — | — | — | 30,0 |
| S1/5 | — | 100,0 | 19,0 | — | 35,0 | — | — |
| S1/7 | — | 100,0 | 19,0 | — | 50,0 | — | — |
| S1/8 | — | 100,0 | 19,0 | — | — | 50,0 | — |

TABLE 3-continued

| Feed Compositions Composition (Mass % of the ore/metal fines) | | | | | | | |
|---|---|---|---|---|---|---|---|
| Recipe Designation | Metal fines | Winterveld ore | Quartz | Lime | Coal −2 mm | Coal −12 mm | Coal −2 mm |
| S2/1 | — | 100,0 | 25,0 | — | — | — | 30,0 |
| S3/1 | — | 100,0 | 20,0 | 5,0 | 10,0 | — | 20,0 |
| S3/2 | — | 100,0 | 20,0 | 5,0 | — | 40,0 | — |

Notation:
M — Metal fines Recipe
S — Smelting Recipe
(S1 = Standard Recipe)
(S2 = Additional Quartz)
(S3 = Lime addition)

The "Standard Recipe" was chosen to give a slag with suitable metallurgical characteristics namely a liquidus temperature of 1600° to 1650° C. and a viscosity of 3 to 8 poise. The slag composition was initially assumed to be 12% $Cr_2O_3$, 6% FeO, 35% $SiO_2$, 35% CaO, 19,3% MgO and 27,4% $Al_2O_3$ and provision was made for 10 to 15% excess carbon on this basis. However, substantially lower values for $Cr_2O_3$ and FeO were achieved and the excess carbon was sufficient to meet these requirements.

The tests were conducted in the plasma furnace which had been preheated with a conventional carbon arc prior to striking of the plasma with the plasma gun and the material was fed into the furnace at a rate calculated to correspond with that at which the required reactions were taking place. The process temperature was continuously monitored to ensure that the energy balance criteria namely; feed rate and power level were satisfied.

In all cases the temperature of the molten ferrochromium metal was about 1600° C. as was the temperature of the slag.

The results obtained after tapping of the slag and the molten metal are reflected, in the case of the tests conducted without the exclusion of oxygen, in Table 4 whilst the results obtained in respect of tests conducted according to the present invention (i.e. with the exclusion of oxygen) are reflected in Table 5.

TABLE 4A

| | FEED MASSES, kg | | | | |
|---|---|---|---|---|---|
| Recipe | Ore | Quartz | Lime | Coal | Char |
| S1/5 | 58,5 | 11,1 | — | 20,5 | — |
| S1/5 | 220,8 | 42,0 | — | 77,3 | — |
| S1/5 | 77,9 | 14,8 | — | 27,3 | — |
| S1/5 | 243,5 | 46,3 | — | 85,2 | — |
| S1/5 | 230,5 | 43,8 | — | 80,7 | — |
| S1/5 | 246,8 | 46,9 | — | 86,4 | — |
| S1/5 | 227,3 | 43,2 | — | 79,6 | — |
| S1/5 & S3/2 | 234,6 | 43,5 | 1,2 | 81,1 | — |
| S1/5 | 58,5 | 11,1 | — | 20,5 | — |
| S3/2 & S1/5 | 112,8 | 17,8 | 2,2 | 38,9 | — |
| | 165,9 | 26,2 | 3,3 | 57,2 | — |
| | 254,7 | 46,3 | 1,3 | 88,8 | — |
| S1/5 | 97,4 | 18,5 | — | 34,1 | — |

TABLE 4B

| | SLAG Composition (% by mass) | | | | | |
|---|---|---|---|---|---|---|
| Recipe | $Cr_2O_3$ | FeO | $SiO_2$ | CaO | MgO | $Al_2O_3$ |
| S1/5 | 14,4 | 1,9 | 35,5 | 0,6 | 22,3 | 24,8 |
| S1/5 | 19,5 | 3,1 | 33,5 | 0,5 | 19,8 | 23,8 |
| S1/5 | 21,1 | 2,3 | 33,2 | 0,4 | 19,8 | 23,9 |
| S1/5 | 22,2 | 1,7 | 33,2 | 0,5 | 19,2 | 24,0 |

TABLE 4B-continued

| Recipe | SLAG Composition (% by mass) | | | | | |
|---|---|---|---|---|---|---|
| | $Cr_2O_3$ | FeO | $SiO_2$ | CaO | MgO | $Al_2O_3$ |
| S1/5 | 21,4 | 2,7 | 32,7 | 0,5 | 18,7 | 24,2 |
| S1/5 | 22,2 | 2,7 | 33,4 | 0,4 | 18,2 | 24,1 |
| S1/5 | 23,3 | 3,6 | 32,8 | 0,4 | 18,2 | 22,7 |
| S1/5 & S3/2 | 21,0 | 1,9 | 34,0 | 0,7 | 18,7 | 24,4 |
| S1/5 | 20,1 | 1,4 | 34,0 | 0,7 | 18,9 | 25,2 |
| S3/2 & | 26,5 | 6,7 | 21,7 | 1,1 | 17,7 | 21,9 |
| | 18,1 | 2,4 | 35,1 | 2,4 | 18,3 | 24,3 |
| S1/5 | 22,6 | 4,2 | 29,9 | 1,7 | 18,0 | 24,4 |
| S1/5 | 23,0 | 2,5 | 31,3 | 1,5 | 18,3 | 25,0 |

TABLE 4C

| Recipe No. | ACTUAL METAL Composition (% by mass) | | | | |
|---|---|---|---|---|---|
| | Cr | Fe | Si | C | S |
| S1/5 | 51,7 | 41,0 | 0,3 | 5,7 | 0,10 |
| S1/5 | *51,9 | 41,3 | 0,5 | 5,5 | — |
| S1/5 | 52,1 | 41,5 | 0,6 | 5,3 | 0,10 |
| S1/5 | 48,7 | 44,9 | 0,4 | 5,4 | 0,08 |
| S1/5 | 51,7 | 42,8 | 0,4 | 5,2 | 0,10 |
| S1/5 | 52,3 | 40,8 | 0,5 | 5,2 | 0,08 |
| S1/5 | 51,7 | 41,6 | 0,4 | 5,5 | 0,08 |
| S1/5 & S3/2 | 52,0 | 40,0 | 0,5 | 5,2 | 0,06 |
| S1/5 | 52,1 | 41,4 | 0,6 | 5,0 | 0,09 |
| S3/2 & | 51,5 | 42,3 | 0,3 | 5,0 | 0,09 |
| | 49,3 | 44,4 | 0,3 | 5,3 | 0,10 |
| S1/5 | 51,5 | 42,5 | 0,2 | 5,2 | 0,11 |
| S1/5 | 51,1 | 43,6 | 0,1 | 4,8 | 0,08 |

TABLE 5A

| Recipe No. | FEED Masses, Kg | | | | |
|---|---|---|---|---|---|
| | Ore | Quartz | Lime | Coal | Char |
| S1/7 & S2/1 | 392,0 | 71,0 | — | 14,0 | 110,0 |
| S2/1 | 417,0 | 104,0 | — | — | 126,0 |
| S1/3 | 416,0 | 104,0 | — | — | 126,0 |
| S1/7 + 8 | 372,0 | 70,0 | — | 178,0 | — |
| S3/2 | 109,0 | 22,0 | 5,0 | 44,0 | — |
| * | 535,0 | 113,0 | 17,0 | 118,0 | 73,0 |
| S3/2 | 350,0 | 70,0 | 17,0 | 140,0 | — |

TABLE 5B

| Recipe No. | SLAG Composition (% by mass) | | | | | |
|---|---|---|---|---|---|---|
| | $Cr_2O_3$ | FeO | $SlO_2$ | CaO | MfO | $Al_2O_3$ |
| S1/7 & S1/3 | 9,8 | 3,1 | 36,5 | 0,7 | 21,0 | 28,9 |
| S2/1 | 4,1 | 2,0 | 35,2 | 0,9 | 23,1 | 34,4 |
| S2/1 | 4,9 | 1,7 | 34,7 | 1,0 | 24,0 | 33,9 |
| S1/7 + 8 | 3,9 | 1,1 | 31,7 | 0,9 | 27,8 | 33,7 |
| S3/2 | 2,9 | 0,7 | 31,6 | 3,0 | 28,5 | 32,6 |
| * | 6,3 | 2,1 | 34,1 | 3,8 | 29,6 | 22,2 |
| S3/2 | 3,2 | 0,9 | 35,0 | 5,4 | 26,1 | 27,1 |

TABLE 5C

| Recipe | METAL COMPOSITION (% by mass) | | | | | | |
|---|---|---|---|---|---|---|---|
| | Actual Cr | Calc. Cr | Actual Fe | Calc. Fe | Si | C | S |
| S1/7 & S1/3 | 44,5 | 56 | 46,3 | 35 | 1,7 | 5,0 | 0,09 |
| 0,09 | | | | | | | |
| S2/1 | 50,3 | 53 | 34,1 | 31 | 7,8 | 5,6 | 0,02 |
| S2/1 | 50,4 | 53 | 33,7 | 32 | 8,3 | 5,6 | 0,07 |
| S1/7+8 | 53,1 | 55 | 35,7 | 34 | 3,7 | 5,7 | 0,04 |

TABLE 5C-continued

| Recipe | METAL COMPOSITION (% by mass) | | | | | | |
|---|---|---|---|---|---|---|---|
| | Actual Cr | Calc. Cr | Actual Fe | Calc. Fe | Si | C | S |
| S3/2 | 53,3 | 56 | 36,1 | 34 | 3,6 | 5,4 | 0,04 |
| * | 54,6 | 56 | 36,0 | 34 | 1,1 | 6,8 | — |
| S3/2 | 45,9 | 57 | 44,8 | 34 | 1,3 | 5,4 | 0,08 |

*Four recipes combined S3/2, S2/1, Sl/8, S3/1
Calc. = Calculated

The calculated composition of the metal was, in fact, determined as a result of the measured composition of the slag as a result of the fact that there was always a non-respresentative metal, usually iron, in the furnace when the tests were conducted. The actual metal analysis therefore sometimes reflects higher iron and lower chromium contents than would have been the case otherwise. Both theoretical and actual values are thus shown in Table 5. The use of larger proportions of lime or limestone could easily be made to lower the sulphur content of the metal.

It will be noted from an examination of the slag compositions that, in the case where air, and thus oxygen, was not excluded, between 14% and 27% of the slag consisted of chromic oxide after tapping. As opposed to this a maximum of 9,8% and in most cases less than 5% of the slag consisted of chromic oxide treatment according to this invention even though both treatments took place in the plasma arc furnace. An examination of the slag showed that a substantial portion of the undissolved chromic oxide occured as undissolved chromium spinel from the feed in the case where air was not excluded. The exclusion of oxygen is therefore critical to the invention and, with a correctly chosen feed, can be used to produce a ferrochromium metal with very small losses to the slag. This is exemplified by the fact that an unreduced chromic oxide content as low as 2,9% of the slag resulted from a run in which it was calculated that an oxygen partial pressure of approximately $10^{-9}$ atmospheres had been maintained at least until the final stages of the process.

It will be understood that the exact conditions of each furnace run must be selected according to requirements and, as a result, appreciable test work and research must be conducted to determine optimum conditions within the framework of this invention.

Simply to exemplify the applications of the invention to metal fines exactly analogous tests were conducted in the same furnace and employing the metal fines composition reflected above in Tables 1 and 2. The mixture fed to the furnace was that reflected under the designation M2 in Table 3.

Although a slag containing 27% of chromic oxide accompanied the metal fines, this chromic oxide was partly reduced to chromium metal which formed part of the ferrochromium to the extent that the chromic oxide content remaining was only 5%. An appreciable recovery of the chromium metal present in the chromite in the metal fines was therefore achieved in addition to the melting of the metal fines to form ferrochromium metal which could then be broken up into lumps as required.

EXAMPLE 2

Graphite Consumable Cathode

A series of similar tests to those described above were carried out in a 100 kV.A direct current thermal plasma furnace of substantially conventional open arc construction except for the provision for anodic contact with the molten bath via stainless steel rods embedded in the hearth. A single centrally located hollow graphite electrode, which was fitted with an axial positioning mechanism, formed the cathode. Care was taken to ensure that the cathode was not in direct contact with the molten bath, except briefly to initiate the plasma arc, and that air was substantially excluded from the furnace. This furnace was monitored and controlled in the same way as the furnace in example 1, so that the plasma gun type formed the principal experimental difference. The raw materials used were the same as those described in Tables 1 and 2, while the feed mixture used, as well as the compositions of the slags resulting from these tests, are given in Table 6 below. The low residual chromic oxide concentrations in these slags are similar to those obtained in example 1 and indicate the wide applicability of this invention to various transferred arc thermal plasma furnace configurations.

TABLE 6

| | | Winter-veld ore | Quartz | Lime-stone | Coal (−2 mm) | | |
|---|---|---|---|---|---|---|---|
| Feed mixture per batch (kgs) | | 29,4 | 5,9 | 2,9 | 11,8 | | |
| | | $Cr_2O_3$ | FeO | $SiO_2$ | CaO | MgO | $Al_2O_3$ |
| Slag composition (% by mass) | (A) | 1,85 | 1,00 | 32,7 | 9,80 | 31,7 | 22,4 |
| | (B) | 0,97 | 0,13 | 38,9 | 9,64 | 25,0 | 20,3 |

It will be appreciated that many variations may be made to the above described procedures without departing from the scope of this invention. In particular it is envisaged that ferrochromium metal fines may well be admixed with chromite ore in a type of recycling operation thereby obviating the necessity of melting ferrochromium metal fines in a separate procedure. As mentioned above the exact constraints applying to each situation will vary and accordingly different variables will apply in different circumstances.

It is envisaged that the invention provides a highly useful method of producing and treating ferrochromium metal which will enable recoveries to be achieved in excess of 95% of chromium content of chromite ores which has, heretofore, not been possible.

What we claim as new and desire to secure by Letters Patent is:

1. A process for the production or treatment of ferrochromium metal comprising the steps of:

(a) feeding a feed material comprising unreduced or partly reduced chromium and iron oxides, a carbonaceous reductant, and a slagging agent to a reaction zone in a furnace bath, the slagging agent providing a slag liquidus not appreciably higher than the ferrochromium metal liquidus temperature in the furnace bath;

(b) maintaining the reaction zone in a substantially oxygen free condition;

(c) heating the reaction zone by a transferred arc thermal plasma to maintain a liquid slag phase and a molten metal phase in the reaction zone;

(d) controlling the feed rate of the feed materials to the reaction zone to maintain approximately a constant temperature in the furnace bath; and (e) tapping the slag and ferrochromium metal.

2. A process as claimed in claim 1 in which the partial pressure of oxygen in the reaction zone is a maximum of $10^{-8}$ atmospheres at least for the major part of the duration of the process.

3. A process as claimed in claim 1 in which the partial pressure of oxygen in the reaction zone is of the order of $10^{-12}$ atmospheres.

4. A process as claimed in claim 1 in which the feed materials are purged with inert gas prior to being fed to the reaction zone.

5. A process claimed in claim 1 in which the interior of the furnace is operated at a slight positive pressure to enhance the exclusion of air.

6. A process as claimed in claim 1 in which the transferred arc thermal plasma is generated by a direct current power supply.

7. A process as claimed in claim 1 in which the feed materials are intimately premixed.

8. A process as claimed in claim 1 in which the feed materials include at least a substantial proportion of chromite ore.

9. A process as claimed in claim 1 in which the feed materials are capable of smelting of the chromite ore.

10. A process as claimed in claim 1 in which the feed materials include ferrochromium metal fines.

11. A process as claimed in claim 1 in which the feed materials include subdivided coal.

12. A process as claimed in claim 11 in which substantially all of the carbonaceous reductant is in the form of coal.

13. A process as claimed in claim 1 in which the carbonaceous reductant is present in an excess of the stoichiometric amount required to ensure that oxygen present in the reaction zone is substantially in the form of carbon monoxide.

14. A process as claimed in claim 1 in which the feed rate is controlled to maintain the temperature and molten condition of the metal and slag at a preselected value.

15. Ferrochromium metal produced by the process of claim 1.

* * * * *